US008500927B2

(12) United States Patent
Tachibana et al.

(10) Patent No.: US 8,500,927 B2
(45) Date of Patent: Aug. 6, 2013

(54) MANUFACTURING APPARATUS OF HOT-ROLLED STEEL SHEET AND MANUFACTURING METHOD OF HOT ROLLED STEEL SHEET

(75) Inventors: Hisayoshi Tachibana, Kashima (JP); Shigemasa Nakagawa, Narashino (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/466,395

(22) Filed: May 8, 2012

(65) Prior Publication Data

US 2012/0216923 A1 Aug. 30, 2012

Related U.S. Application Data

(63) Continuation of application No. PCT/JP2010/070613, filed on Nov. 18, 2010.

(30) Foreign Application Priority Data

Nov. 24, 2009 (JP) ..... 2009-266773

(51) Int. Cl.
*C21D 11/00* (2006.01)
*C21D 8/02* (2006.01)
*B21B 37/00* (2006.01)

(52) U.S. Cl.
USPC ..... 148/511; 148/654; 266/46; 266/99; 266/113; 266/114; 72/201; 72/364; 72/366.2

(58) Field of Classification Search
USPC ..... 148/511, 654; 266/46, 99, 113, 266/114; 72/201, 364, 366.2
See application file for complete search history.

(56) References Cited

U.S. PATENT DOCUMENTS

| | | | | |
|---|---|---|---|---|
| 6,860,950 | B2 * | 3/2005 | Franz et al. | 148/503 |
| 6,866,729 | B2 * | 3/2005 | Gramckow et al. | 148/511 |
| 7,523,631 | B2 * | 4/2009 | Fujibayashi et al. | 72/201 |
| 7,556,701 | B2 * | 7/2009 | Fujibayashi et al. | 148/333 |
| 2002/0020474 | A1 * | 2/2002 | Meyer et al. | 148/511 |
| 2012/0174645 | A1 * | 7/2012 | Serizawa et al. | 72/201 |
| 2012/0216924 | A1 * | 8/2012 | Ota | 148/511 |
| 2012/0318414 | A1 * | 12/2012 | Tachibana et al. | 148/567 |

FOREIGN PATENT DOCUMENTS

| | | | |
|---|---|---|---|
| JP | 401062206 | A * | 3/1989 |
| JP | 2001-246409 | | 9/2001 |
| JP | 2006-010130 | | 1/2006 |
| JP | 2006-035233 | | 2/2006 |

* cited by examiner

*Primary Examiner* — Deborah Yee
(74) *Attorney, Agent, or Firm* — Clark & Brody

(57) ABSTRACT

The present invention provides a manufacturing apparatus of a hot-rolled steel sheet capable of cooling control of a steel sheet even when disposing a cooling device capable of cooling from inside a finishing mill.

The manufacturing apparatus of a hot-rolled steel sheet comprises: an immediate rapid-cooling device capable of spraying cooling water, at least a part thereof being disposed inside a final stand in the row of hot finishing mills; a device for measuring a temperature on an entry side of a final stand; a device for measuring a steel sheet passing speed; a device for predicting a rapid-cooling stopping temperature which calculates a predicted rapid-cooling stopping temperature; and an immediate rapid-cooling control device which corrects the water supply volume or water supply pressure of the immediate rapid-cooling device such that the predicted rapid-cooling stopping temperature matches a targeted rapid-cooling stopping temperature.

8 Claims, 5 Drawing Sheets

MANUFACTURING APPARATUS OF HOT-ROLLED STEEL SHEET AND MANUFACTURING METHOD OF HOT ROLLED STEEL SHEET

TECHNICAL FIELD

The present invention relates to a manufacturing apparatus of a hot-rolled sheet and a manufacturing method of a hot-rolled steel sheet. More specifically, it relates to a manufacturing apparatus of a hot-rolled sheet and a manufacturing method of a hot-rolled steel sheet in which in manufacturing a hot-rolled steel sheet by spraying cooling water at a high-temperature steel sheet that has just been rolled in a hot finishing mill, to water-cool it, it is possible to accurately control a temperature of the steel sheet after stopping the cooling.

BACKGROUND ART

A steel material used for automobiles, structural materials, and the like is required to be excellent in such mechanical properties as strength, workability, and toughness. In order to improve these mechanical properties comprehensively, it is effective to refine the structure of the steel material. To this end, a number of manufacturing methods for obtaining a steel material with a fine-grained structure have been sought. Further, by refining the structure, it is possible to obtain a high-strength hot-rolled steel sheet having excellent mechanical properties even if the amount of alloy elements added is reduced.

As a method for refining the structure of a steel material, it is known that a large rolling reduction is carried out especially in the later stage of hot finish rolling to refine austenite grains; and to increase rolling strains in a steel sheet, thereby obtaining fine ferrite grains after rolling. Further, in view of inhibiting recrystallization and recovery of the austenite grains and facilitating the ferrite transformation, it is effective to cool the steel sheet to a temperature from 600° C. to 750° C. as quickly as possible after rolling. That is, subsequent to hot finish rolling, it is effective to arrange a cooling device capable of cooling more quickly than ever before to thereby rapidly cool the steel sheet after the rolling. And in rapidly cooling the post-rolled steel sheet in this way, it is effective to increase a volume of cooling water per unit area sprayed over the steel sheet, that is, to increase a water flow density in order to enhance a cooling capability.

On the other hand, not only is it necessary to simply perform rapid cooling in this way, it is also required to accurately stop cooling so as to obtain a required metal structure; and to control a temperature of a steel sheet at a time of stopping the rapid cooling, to a predetermined temperature. Thereby, a desired steel sheet structure can be obtained and the quality of a large number of steel sheets manufactured can be stabilized.

Here, the temperature at a time of stopping rapid cooling is hereinafter referred to as a rapid-cooling stopping temperature. The rapid-cooling stopping temperature is described below in more detail. A temperature distribution in a thickness direction of a steel sheet during rapid cooling is in a transient state where the heat on the surface layer area is rapidly deprived due to the rapid cooling and the surface temperature is lower than the central temperature. When the rapid cooling is stopped in such a state, the heat in the central area is diffused toward the surface layer area, as time passes, to become uniform. The rapid-cooling stopping temperature refers to a temperature of a steel sheet in this uniform state; and is almost equivalent to a value obtained by measuring a surface temperature of a steel sheet with a radiation thermometer after a certain amount of time passes from the time when the rapid cooling has been stopped.

Patent Document 1 discloses a manufacturing method of a hot-rolled steel sheet characterized in that: when changing, during hot rolling, to other hot-rolling conditions different from prescribed hot-rolling conditions, and continuing hot rolling, the values of cooling conditions set for a water-cooling device, which values enable a coiling temperature of a steel sheet to become a target value, are determined based on these other hot-rolling conditions and on a measured value of a temperature of the steel sheet on an entry side of the water-cooling device; and further the set values of the cooling conditions of the water-cooling device are corrected and reset based on these other hot-rolling conditions and on the measured value of the temperature of the steel sheet on the entry side of the water-cooling device. According to this, the temperature of the steel sheet after rolling can be controlled to a target temperature.

Thus, Patent Document 1 suggests a cooling method comprising arranging a rapid-cooling device on an exit side of a hot finishing mill, wherein a thermometer is disposed between the finishing mill and the rapid-cooling device.

CITATION LIST

Patent Literature

Patent Document 1: Japanese Patent Application Laid-Open No. 2001-246409

SUMMARY OF INVENTION

Problems to be Solved by the Invention

As described above, it is effective to cool a steel sheet as strongly and quickly as possible after hot finish rolling; therefore, it is preferable to perform cooling from immediately after a work roll of a final stand in a row of hot finishing mills. That is, cooling water is sprayed at a steel sheet to cool it, the steel sheet existing inside a housing of the final stand in the row of hot finishing mills.

However, when performing such cooling, it is impossible to measure a temperature of a steel sheet between a hot finishing mill and a cooling device; thus it is also impossible to perform the cooling water control as described in Patent Document 1.

Accordingly, in view of the above problems, an object of the present invention is to provide a manufacturing apparatus of a hot-rolled steel sheet and a manufacturing method of a hot-rolled steel sheet which enable cooling control of a steel sheet even in a case of disposing a cooling device capable of cooling from inside a finishing mill, in a manufacturing line of a hot-rolled steel sheet.

Means for Solving the Problems

The present invention will be described below. Although the reference symbols given in accompanying drawings are shown in parentheses for the purpose of easy understanding, the invention is not limited to an embodiment shown in the drawings.

A first aspect of the present invention is a manufacturing apparatus (10) of a hot-rolled steel sheet comprising: a row (11) of hot finishing mills; an immediate rapid-cooling device (20), which is disposed on an exit side of a final stand (11*g*) in the row of hot finishing mills, and at least a part of which is disposed inside the final stand so as to be capable of spraying cooling water; a device (45) for measuring a temperature on an entry side of a final stand, which is arranged in a manner capable of measuring a surface temperature of a steel sheet on an entry side of the final stand; a device (47) for measuring a steel sheet passing speed, which is arranged in a manner capable of measuring a passing speed of the steel sheet on the entry side of the final stand; a device (51) for predicting a rapid-cooling stopping temperature, which calculates a predicted rapid-cooling stopping temperature based on the surface temperature of the steel sheet measured by the device for measuring a temperature on an entry side of a final stand, the steel sheet passing speed measured by the device for measuring the steel sheet passing speed, and the water supply volume or water supply pressure of the immediate rapid-cooling device; and an immediate rapid-cooling control device (52), which corrects the water supply volume or water supply pressure of the immediate rapid-cooling device such that the predicted rapid-cooling stopping temperature matches a targeted rapid-cooling stopping temperature.

A second aspect of the present invention is a manufacturing method of a hot-rolled steel sheet using the manufacturing apparatus (10) of a hot-rolled steel sheet according to the first aspect, wherein with a measured value of the steel sheet temperature on the entry side of the final stand (11*g*) as an initial value, the predicted rapid-cooling stopping temperature is calculated based on the surface temperature of the steel sheet and the water supply volume or water supply pressure of the immediate rapid-cooling device (20); and the water supply volume or water supply pressure of the immediate rapid-cooling device is corrected such that the predicted rapid-cooling stopping temperature matches a targeted rapid-cooling stopping temperature.

A third aspect of the present invention is a a manufacturing apparatus (10) of a hot-rolled steel sheet comprising: a row (11) of hot finishing mills; an immediate rapid-cooling device (20), which is disposed on an exit side of a final stand (11*g*) in the row of hot finishing mills, and at least a part of which is disposed inside the final stand so as to be capable of spraying cooling water; a device (45) for measuring a temperature on an entry side of a final stand, which is arranged in a manner capable of measuring a surface temperature of a steel sheet on an entry side of the final stand; a device (48) for measuring a temperature on an exit side of an immediate rapid-cooling device, which is arranged in a manner capable of measuring the surface temperature of the steel sheet on an exit side of the immediate rapid-cooling device; a device (47) for measuring a steel sheet passing speed, which is arranged in a manner capable of measuring a passing speed of the steel sheet on the entry side of the final stand; a device (51) for predicting a rapid-cooling stopping temperature, which calculates a predicted rapid-cooling stopping temperature based on the surface temperature of the steel sheet measured by the device for measuring a temperature on an entry side of a final stand, the steel sheet passing speed measured by the device for measuring a steel sheet passing speed, and the water supply volume or water supply pressure of the immediate rapid-cooling device; and an immediate rapid-cooling control device (52), which corrects the water supply volume or water supply pressure of the immediate rapid-cooling device such that the predicted rapid-cooling stopping temperature matches a targeted rapid-cooling stopping temperature, until a top portion of the steel sheet passes through the immediate rapid-cooling device, and which corrects the water supply volume or water supply pressure of the immediate, rapid-cooling device, or the steel sheet passing speed such that the steel sheet temperature measured by the device for measuring a temperature on an exit side of an immediate rapid-cooling device matches the targeted rapid-cooling stopping temperature, after the top portion of the steel sheet passes through the immediate rapid-cooling device.

A fourth aspect of the present invention is a manufacturing method of a hot-rolled steel sheet using the manufacturing apparatus (10) of a hot-rolled steel sheet according to the third aspect, wherein until the top portion of the steel sheet passes through the immediate rapid-cooling device (20), with a measured value of the steel sheet temperature on the entry side of the final stand (11*g*) as an initial value, the predicted rapid-cooling stopping temperature is calculated based on the surface temperature of the steel sheet and the water supply volume or water supply pressure of the immediate rapid-cooling device, and the water supply volume or water supply pressure of the immediate rapid-cooling device is corrected such that the predicted rapid-cooling stopping temperature matches a targeted rapid-cooling stopping temperature; and after the top portion of the steel sheet passes through the immediate rapid-cooling device, the water supply volume or water supply pressure of the immediate rapid-cooling device, or the steel sheet passing speed is corrected such that the measured value by the device (48) for measuring a temperature on an exit side of an immediate rapid-cooling device matches the targeted rapid-cooling stopping temperature.

A fifth aspect of the present invention is a manufacturing apparatus (110) of a hot-rolled steel sheet comprising: a row (11) of hot finishing mills; an immediate rapid-cooling device (20), which is disposed on an exit side of a final stand (11*g*) in the row of hot finishing mills, and at least a part of which is disposed inside the final stand so as to be capable of spraying cooling water; a hot-run cooling device (40), which is disposed on an outer side of the immediate rapid-cooling device; a device (45) for measuring a temperature on an entry side of a final stand, which is arranged in a manner capable of measuring a surface temperature of a steel sheet on an entry side of the final stand; a device (47) for measuring a steel sheet passing speed, which is arranged in a manner capable of measuring a passing speed of the steel sheet on the entry side of the final stand; a device (151) for predicting a rapid-cooling stopping temperature/coiling temperature, which calculates a predicted rapid-cooling stopping temperature and predicted coiling temperature based on the surface temperature of the steel sheet measured by the device for measuring a temperature on an entry side of a final stand, the steel sheet passing speed measured by the device for measuring a steel sheet passing speed, the water supply volume or water supply pressure of the immediate rapid-cooling device, and the water supply volume of the hot-run cooling device; and an immediate rapid-cooling/hot-run cooling control device (152), which corrects the water supply volume or water supply pressure of the immediate rapid-cooling device such that the predicted rapid-cooling stopping temperature and predicted coiling temperature match a targeted rapid-cooling stopping temperature and targeted coiling temperature.

A sixth aspect of the present invention is a manufacturing method of a hot-rolled steel sheet using the manufacturing apparatus (110) of a hot-rolled steel sheet according to the fifth aspect, wherein with a measured value of the steel sheet temperature on the entry side of the final stand (11*g*) as an initial value, the predicted rapid-cooling stopping temperature and predicted coiling temperature are calculated based on the surface temperature of the steel sheet, the water supply volume or water supply pressure of the immediate rapid-cooling device (20), and the water supply volume of the hot-run cooling device (40); and the water supply volume or water supply pressure of the immediate rapid-cooling device is corrected and the water supply volume of the hot-run cooling device is corrected, such that the predicted rapid-cooling stopping temperature and predicted coiling temperature match a targeted rapid-cooling stopping temperature and targeted coiling temperature.

A seventh aspect of the present invention is a manufacturing apparatus (110) of a hot-rolled steel sheet comprising: a row (11) of hot finishing mills; an immediate rapid-cooling device (20), which is disposed on an exit side of a final stand (11*g*) in the row of hot finishing mills, and at least a part of which is disposed inside the final stand so as to be capable of spraying cooling water; a hot-run cooling device (40), which is disposed on an outer side of the immediate rapid-cooling device; a device (45) for measuring a temperature on an entry side of a final stand, which is arranged in a manner capable of measuring a surface temperature of a steel sheet on an entry side of the final stand; a device (48) for measuring a temperature on an exit side of an immediate rapid-cooling device, which is arranged in a manner capable of measuring the surface temperature of the steel sheet on an exit side of the immediate rapid-cooling device; a device (47) for measuring a steel sheet passing speed, which is arranged in a manner capable of measuring a passing speed of the steel sheet on the entry side of the final stand; a device (151) for predicting a rapid-cooling stopping temperature/coiling temperature, which calculates a predicted rapid-cooling stopping temperature and predicted coiling temperature based on the surface temperature of the steel sheet measured by the device for measuring a temperature on an entry side of a final stand, the steel sheet passing speed measured by the device for measuring a steel sheet passing speed, the water supply volume or water supply pressure of the immediate rapid-cooling device, and the water supply volume of the hot-run cooling device; and an immediate rapid-cooling/hot-run cooling control device (152), which corrects the water supply volume or water supply pressure of the immediate rapid-cooling device and the water supply volume of the hot-run cooling device such that the predicted rapid-cooling stopping temperature and predicted coiling temperature match a targeted rapid-cooling stopping temperature and targeted coiling temperature, until a top portion of the steel sheet passes through the immediate rapid-cooling device, and which corrects the water supply volume or water supply pressure of the immediate rapid-cooling device, or the steel sheet passing speed such that the temperature measured by the device for measuring a temperature on an exit side of an immediate rapid-cooling device matches the targeted rapid-cooling stopping temperature, and corrects the water supply volume of the hot-run cooling device such that the predicted coiling temperature matches the targeted coiling temperature, after the top portion of the steel sheet passes through the immediate rapid-cooling device.

An eighth aspect of the present invention is a manufacturing method of a hot-rolled-steel sheet using the manufacturing apparatus (110) of a hot-rolled steel sheet according to the seventh aspect, wherein until the top portion of the steel sheet passes through the immediate rapid-cooling device (20), with a measured value of the steel sheet temperature on the entry side of the final stand as an initial value, the predicted rapid-cooling stopping temperature and predicted coiling temperature are calculated based on the surface temperature of the steel sheet, the water supply volume or water supply pressure of the immediate rapid-cooling device, and the water supply volume of the hot-run cooling device (40); the water supply volume or water supply pressure of the immediate rapid-cooling device is corrected and the water supply volume of the hot-run cooling device is corrected, such that the predicted rapid-cooling stopping temperature and predicted coiling temperature match a targeted rapid-cooling stopping temperature and targeted coiling temperature; and after the top portion of the steel sheet passes through the immediate rapid-cooling device, the water supply volume or water supply pressure of the immediate rapid-cooling device, or the steel sheet passing speed is corrected such that the temperature measured by the device (48) for measuring a temperature on an exit side of an immediate rapid-cooling device matches the targeted rapid-cooling stopping temperature, and the water supply volume of the hot-run cooling device is corrected such that the predicted coiling temperature matches the targeted coiling temperature.

EFFECTS OF THE INVENTION

According to the manufacturing apparatus of a hot-rolled steel sheet and the manufacturing method of a hot-rolled steel sheet of the present invention, it is possible to control cooling of a steel sheet with high precision even in a case of disposing a cooling device capable of cooling from inside a finishing mill.

BRIEF DESCRIPTION OF THE DRAWINGS

FIG. 2 is an enlarged view focusing on an area in FIG. 1, in which area an immediate rapid-cooling device is disposed.

MODES FOR CARRYING OUT THE INVENTION

The functions and benefits of the present invention described above will be apparent from the following modes for carrying out the invention. The present invention will be described based on the embodiments shown in the accompanying drawings. However, the invention is not limited to these embodiments.

Figure 1:
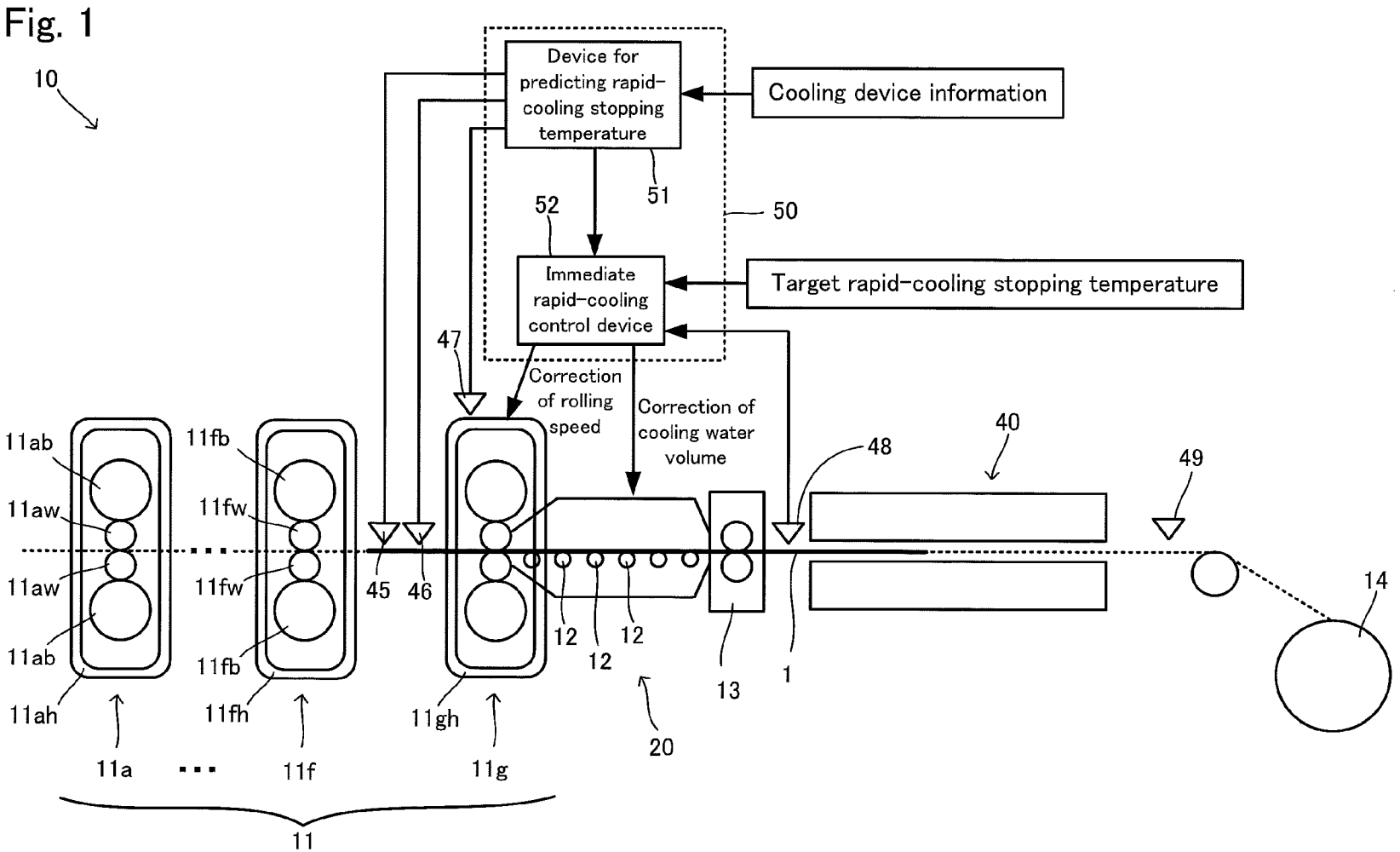
FIG. 1 is a schematic view showing a part of a manufacturing apparatus of a hot-rolled steel sheet according to a first embodiment.

FIG. 1 is a conceptual view illustrating a manufacturing apparatus (10) of a hot-rolled steel sheet according to a first embodiment (hereinafter, referred to as a "manufacturing apparatus 10"). In FIG. 1, a steel sheet 1 is transported from a left on the sheet of paper (upstream side, entry side) to a right (downstream side, exit side); and a top-to-bottom direction on the sheet of paper is a vertical direction. A direction from the upstream side (the entry side) to the downstream side (the exit side) may be referred to as a sheet passing direction; and a direction of a width of the passing steel sheet, which is orthogonal to the sheet passing direction, may be referred to as a width direction of a steel sheet. Further, reference symbols may be omitted in the below descriptions of the drawings for the purpose of easy viewing.

As shown in FIG. 1, the manufacturing apparatus 10 comprises: a row 11 of hot finishing mills; transporting rolls 12, 12, . . . ; a pinch roll 13; a coiling device 14, a immediate rapid-cooling device 20; and a hot-run cooling device 40. Further, the manufacturing apparatus 10 comprises, on an entry side of a final stand 11*g* in the row 11 of hot finishing mills, a device 45 for measuring a temperature on an entry side of a final stand, and a device 46 for measuring a steel sheet thickness. Additionally, the manufacturing apparatus comprises: a device 47 for measuring a steel sheet passing speed disposed in the final stand 11*g*; a device 48 for measuring a temperature on an exit side of an immediate rapid-cooling device disposed on an exit side of the immediate rapid-cooling device 20 immediately after the pinch roll 13; a device 49 for measuring a coiling temperature disposed before the coiling device 14; and also a cooling control device 50. Furthermore, a heating furnace, a row of rough rolling mills, and the like, the figures and descriptions of which are omitted, are arranged on the entry side of the row 11 of hot finishing mills, and set better conditions for a steel sheet to go through the row 11 of hot finishing mills.

A hot-rolled steel sheet is generally manufactured in the following way. A rough bar which has been taken from the heating furnace and has been rolled in the rough rolling mill to have a predetermined thickness is rolled continuously in the row 11 of hot finishing mills to have a predetermined thickness. After that, the steel sheet is rapidly cooled in the immediate rapid-cooling device 20. At this time, the cooling is controlled by the cooling control device 50. Then, the steel sheet passes through the pinch roll 13, and is cooled by the hot-run cooling device 40 to a predetermined coiling temperature to be coiled by the coiling device 14.

Figure 2A:
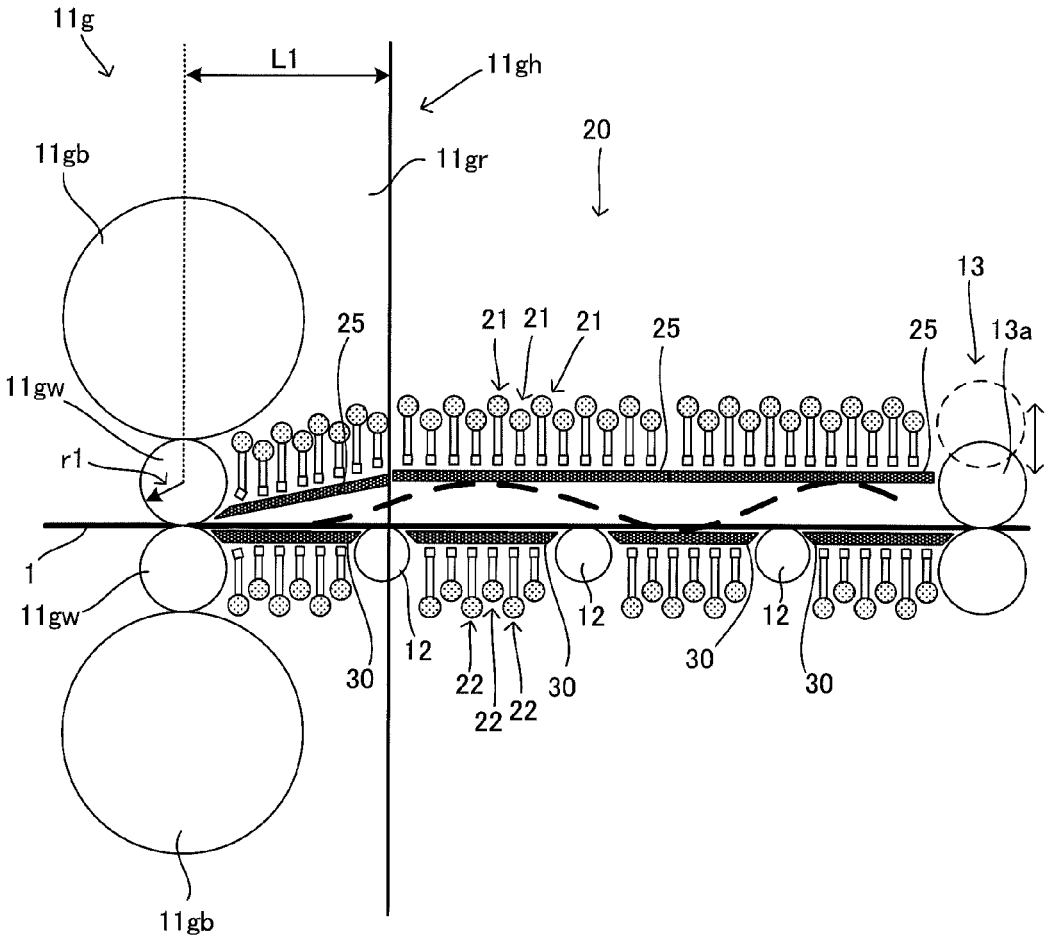
FIG. 2A shows the immediate rapid-cooling device in its entirety.
Figure 2B:
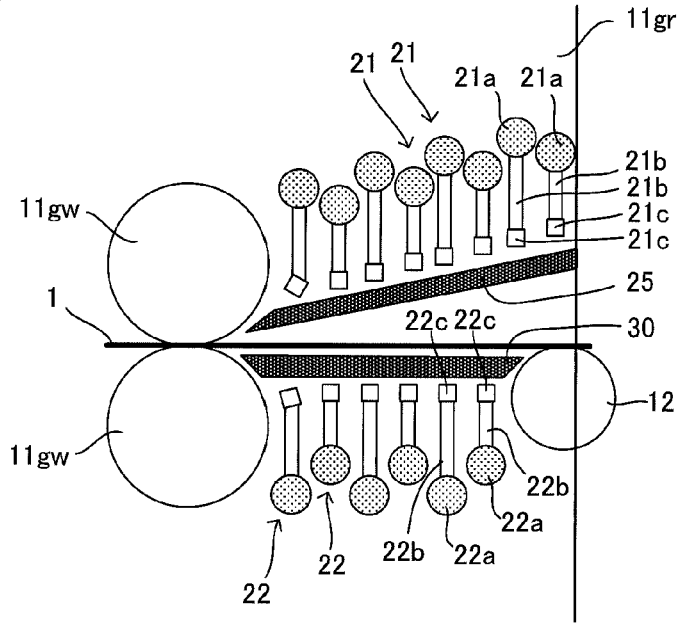
FIG. 2B focuses on the vicinity of a final stand.

Hereinafter, the manufacturing apparatus 10 will be described in detail. FIG. 2 is an enlarged view of an area in FIG. 1, in which area the immediate rapid-cooling device 20 is provided. FIG. 2A is an enlarged view showing the immediate rapid-cooling device 20 in its entirety, whereas FIG. 2B is a view further focusing on the vicinity of the final stand 11*g*.

In the row 11 of hot finishing mills, seven rolling mills 11*a*, . . . , 11*f*, 11*g* are arranged in a row along the sheet passing direction. Each of the rolling mills 11*a*, . . . , 11*f*, 11*g* forms each stand, and rolling conditions such as a rolling reduction are set in each of the rolling mills to enable the steel sheet to meet conditions for thickness, mechanical properties, surface quality, and the like which are required in a final product. Herein, a rolling reduction in each stand is set such that a manufactured steel sheet can meet a required performance. Here, in view of carrying out a large rolling reduction to refine austenite grains and to increase rolling strains in the steel sheet and obtaining fine ferrite grains after rolling, a rolling reduction of 15% to 50%, which is larger than an ordinary rolling reduction, is required in the final stand 11*g*.

The rolling mill in each stand comprises: a pair of work rolls 11*aw*, 11*aw*, . . . , 11*fw*, 11*fw*, 11*gw*, 11*gw* which actually sandwiches the steel sheet therebetween to reduce a thickness thereof; and a pair of backup rolls 11*ab*, 11*ab*, . . . , 11*fb*, 11*fb*, 11*gb*, 11*gb* which is disposed in a manner contacting the outer periphery thereof with the outer periphery of the work rolls. Further, the rolling mill comprises a housing 11*ah*, . . . , 11*fh*, 11*gh* which includes the work rolls and the backup rolls therein and forms an outer shell of the rolling mill to support the rolling rolls. The housing comprises standing side members 11*gr*, 11*gr* which are arranged to stand in an opposing manner. And the standing side members 11*gr*, 11*gr* are arranged to stand in a manner sandwiching the passing steel sheet 1 in the width direction of the steel sheet.

Herein, a distance L1 between the center of the rotary shaft of the work roll 11*gw* and the end face on the exit side of the standing side member 11*gr* of the housing is larger than the radius r1 of the work roll 11*gw*. Therefore, as described below, a part of the immediate rapid-cooling device 20 can be disposed in an area corresponding to the gap L1−r1. That is, it is possible to dispose a part of the immediate rapid-cooling device 20 in such a manner as being incorporated into the housing 11*gh*.

The transporting rolls 12, 12, . . . are a group of transporting rolls which transport the steel sheet 1 in the sheet passing direction.

The pinch roll 13 also serves to remove water, and is arranged on the exist side of the immediate rapid-cooling device 20. This can prevent cooling water sprayed in the immediate rapid-cooling device 20 from flowing out to the exit side of the steel sheet 1. Furthermore, this can prevent the steel sheet 1 from ruffling in the immediate rapid-cooling device 20, and can improve a passing ability of the steel sheet 1 especially at a time before the top portion of the steel sheet 1 is drawn into the coiling device 14. Here, an upper-side roll 13*a* of the pinch roll 13 is configured to be movable up and down, as shown in FIG. 2.

The coiling device 14 is a device for coiling a rolled steel sheet. A known coiling device may be used as the coiling device 14.

The immediate rapid-cooling device 20, as seen from FIGS. 2A and 2B, comprises: upper surface water supplying devices 21, 21, . . . ; lower surface water supplying devices 22, 22, . . . ; upper surface guides 25, 25, . . . ; and lower surface guides 30, 30, . . .

The upper surface water supplying devices 21, 21, . . . are devices to supply cooling water to an upper surface side of the steel sheet 1. The upper surface water supplying devices 21, 21, . . . comprise: cooling headers 21*a*, 21*a*, . . . ; conduits 21*b*, 21*b*, . . . provided, in a row in a plural form, to each of the cooling headers 21*a*, 21*a*, . . . ; and cooling nozzles 21*c*, 21*c*, . . . attached to an end portion of the conduits 21*b*, 21*b*, . . .

The cooling header 21*a* is a pipe extending in the width direction of the steel sheet; and these cooling headers 21*a*, 21*a* are aligned in the sheet passing direction.

The conduits 21*b*, 21*b*, . . . are a plurality of thin pipes diverging from each cooling header 21*a*, and opening ends of the conduits are directed toward the upper surface side of the steel sheet. A plurality of the conduits 21*b*, 21*b*, . . . are arranged in a comb-like manner along a direction of a tube length of the cooling header 21*a*, namely, in the width direction of the steel sheet.

Figure 3:
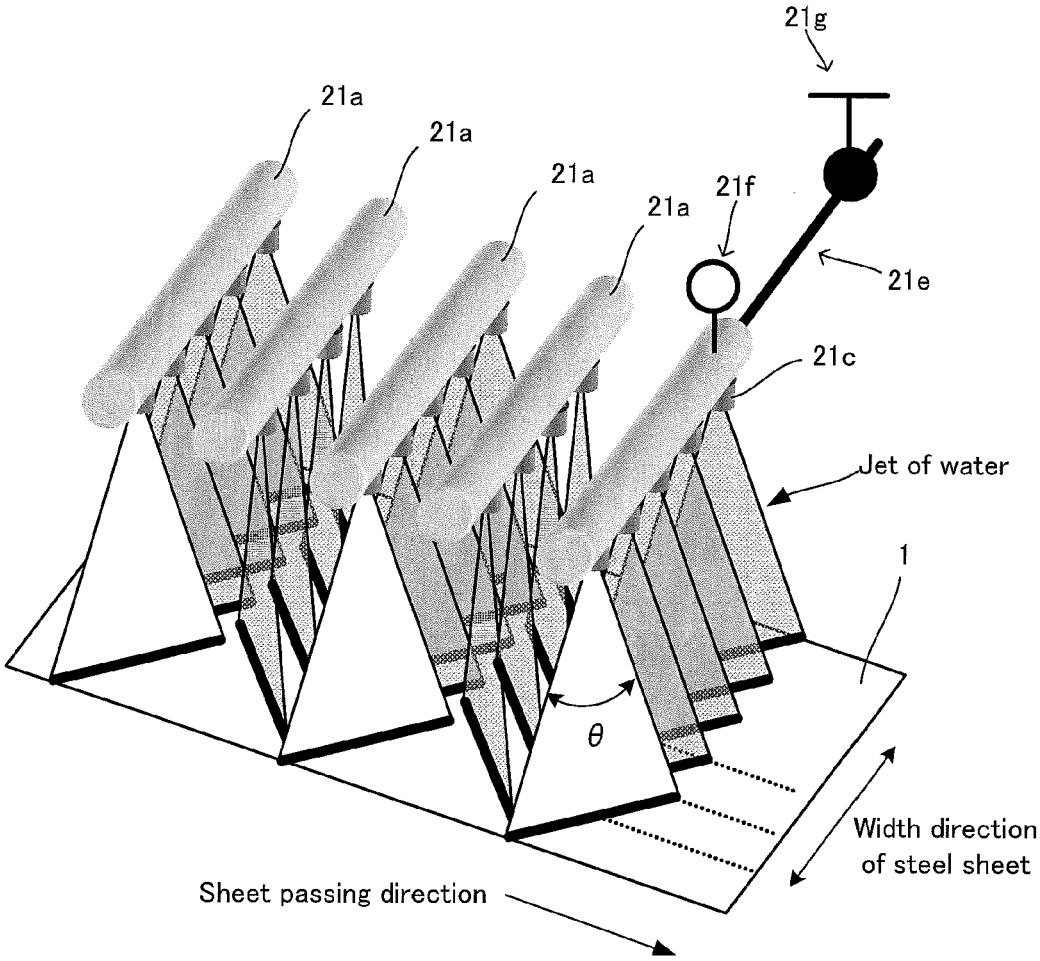
FIG. 3 is a perspective view illustrating cooling nozzles of the immediate rapid-cooling device.
Figure 4:
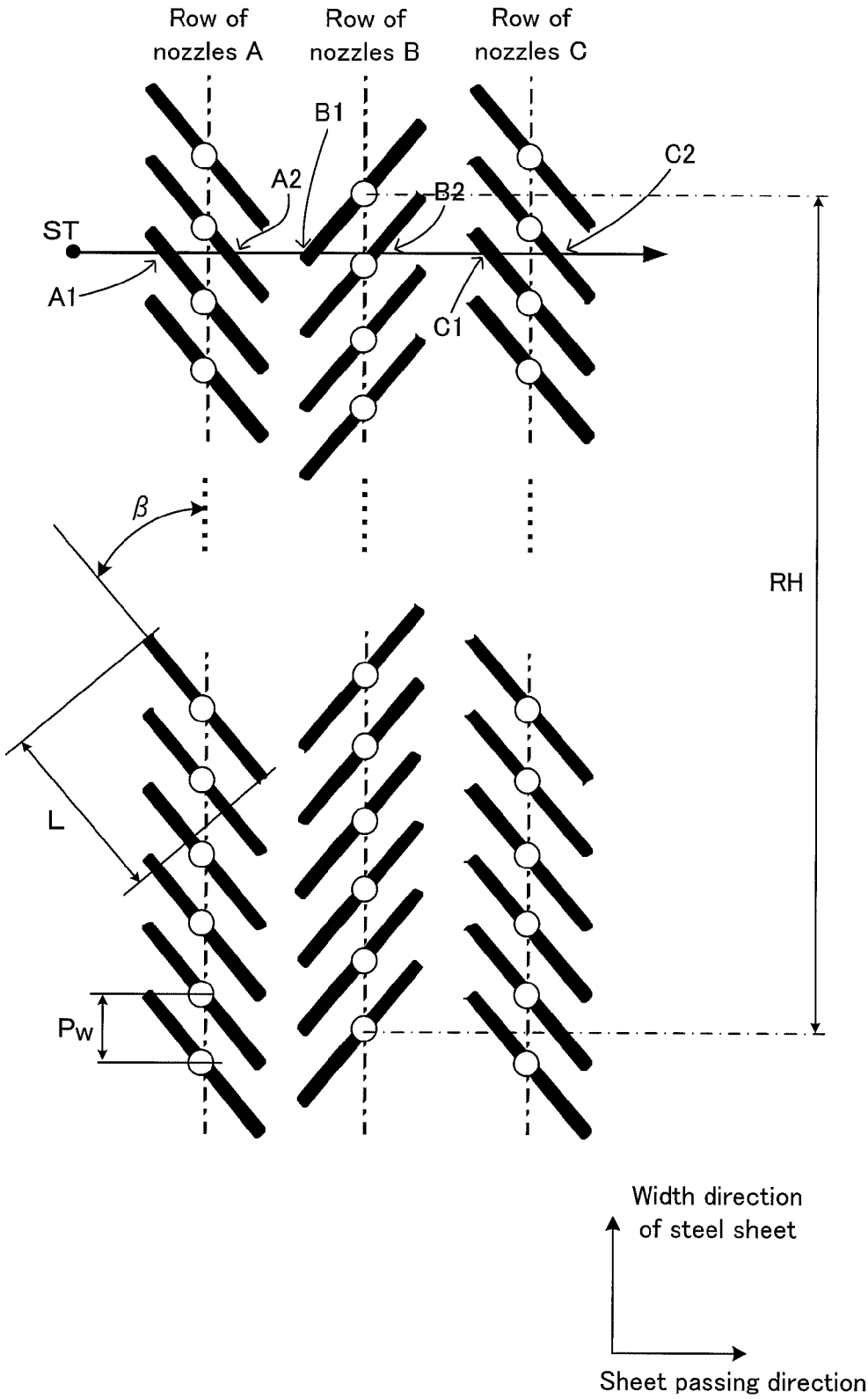
FIG. 4 is a view illustrating an arrangement of the cooling nozzles of the immediate rapid-cooling device.

An end portion of each of the conduits 21*b*, 21*b*, . . . is attached with each of the cooling nozzles 21*c*, 21*c*, . . . The cooling nozzles 21*c*, 21*c*, . . . of the present embodiment are flat spray nozzles capable of forming a fan-like jet of cooling water (for example, a thickness of approximately 5 mm to 30 mm). FIGS. 3 and 4 schematically show the jets of cooling water to be formed on the surface of the steel sheet 1 by the cooling nozzles 21*c*, 21*c*, . . . FIG. 3 is a perspective view. FIG. 4 is a view schematically showing a manner of an impact of the jets of cooling water on the surface of the steel sheet. In FIG. 4, an open circle shows a position right below the cooling nozzles 21*c*, 21*c*, . . . Further, a thick line schematically shows an impact position and shape of the jets of cooling water. FIGS. 3 and 4 show both the sheet passing direction and the sheet width direction. Further, the part indicated by " . . . " in FIG. 4 means that the open circles and the thick lines are omitted for the purpose of easy viewing.

As can be seen from FIGS. 3 and 4, in the embodiment, the rows of nozzles adjacent to each other are arranged such that the position of the cooling nozzles 21*c*, 21*c*, in one of the rows in the width direction of the steel sheet differs from the position of the cooling nozzles 21*c*, 21*c*, . . . in its adjacent row. Further, the rows of nozzles are arranged in a so-called staggered manner so that the position of the cooling nozzles

21c, 21c, . . . in one of the rows in the width direction of the steel sheet becomes the same as the position of the cooling nozzles 21c, 21c, . . . in the row which is located further next.

In the present embodiment, the cooling nozzles 21c, 21c, are arranged such that an entire position on the surface of the steel sheet in the width direction of the steel sheet can receive jets of cooling water at least twice from one row of nozzles. That is, a point ST on which the passing steel sheet is located moves along a linear arrow in FIG. 4. At this time, in such a manner as twice in a row A of nozzles (A1, A2); twice in a row B of nozzles (B1, B2); and twice in a row C of nozzles (C1, C2), in each of the rows of nozzles, the jets of water from the nozzles belonging to the row of nozzles strike twice. Thus, the cooling nozzles 21c, 21c, . . . are arranged such that the following relation is satisfied among a gap $P_w$ between the cooling nozzles 21, 21, . . . ; an impact width L of jets of cooling water; and a twisting angle β.

$$L=2P_w/\cos\beta$$

In the present embodiment, the number of times at which the steel sheet passes through jets of cooling water is set to be twice, to which the number of times is not limited; it may be three or more times. For the purpose of uniforming a cooling capability in the width direction of the steel sheet, in the rows of nozzles adjacent to each other in the sheet passing direction, the cooling nozzles in one of the rows are twisted in an opposite direction from the cooling nozzles in its adjacent row.

Further, a "width of the uniformly cooled region" related to cooling of the steel sheet is determined by an arrangement of the cooling nozzles. This refers to a size, in the width direction of the steel sheet, of the transported steel sheet which can be uniformly cooled based on the characteristics of a group of cooling nozzles arranged. Specifically, the width of the uniformly cooled region is often equivalent to a width of a maximum-sized steel sheet which can be manufactured by the manufacturing apparatus of a steel sheet. More specifically, it is the size shown by RH in FIG. 4, for example.

Here, in the present embodiment, in the rows of nozzles adjacent to each other, the cooling nozzles 21c, 21c, . . . in one of the rows are configured, as described above, to be twisted in the opposite direction from those in its adjacent row. However, a configuration is not necessarily limited to this; all of the cooling nozzles may be twisted in the same direction. Further, a twisting angle (β as above) is not particularly limited, but may be adequately determined in view of a required cooling capability and an arrangement of equipment.

Furthermore, in the present embodiment, in view of the above benefits, the rows of nozzles adjacent to one another in the passing direction of the steel sheet are arranged in a staggered manner. However, a configuration is not limited to this; the cooling nozzles may be configured to be arranged in a linear manner in the sheet passing direction.

A position at which the upper surface water supplying device 21 is provided, in particular, a position at which the cooling nozzles 21c, 21c, . . . are disposed is not particularly limited; however, the upper surface water supplying device, or the cooling nozzles are preferably disposed right after the final stand 11g in the row 11 of hot finishing mills, from inside the housing high of the final stand 11g, in a manner as closely to the work roll 11gw in the final stand 11g as possible. This arrangement enables rapid cooling of the steel sheet 1 immediately after it has been rolled by the row 11 of hot finishing mills. It also enables stably guiding the top portion of the steel sheet 1 to the immediate rapid-cooling device 20. In the present embodiment, as seen from FIG. 2, the cooling nozzles 21c, 21c, . . . close to the work roll 11gw are arranged closely to the steel sheet 1.

Further, a direction in which the cooling water is sprayed from the cooling water ejection outlet of each of the cooling nozzles 21c, 21c, . . . is basically a vertical direction; on the other hand, the ejection of the cooling water from the cooling nozzles 21c, 21c, . . . , 22c, 22c, . . . closest to the work rolls 11gw, 11gw in the final stand 11g are preferably directed more toward the work rolls 11gw, 11gw than vertically. This configuration can further shorten the time period from the thickness reduction of the steel sheet 1 in the final stand 11g to the initiation of cooling the steel sheet. And the recovery time of rolling strains accumulated by rolling can also be reduced to almost zero. Accordingly, a steel sheet having a finer structure can be manufactured.

The lower surface water supplying devices 22, 22, . . . are devices to supply cooling water to the lower surface side of the steel sheet 1. The lower surface water supplying devices 22, 22, . . . comprise: cooling headers 22a, 22a, . . . ; conduits 22b, 22b, . . . provided, in a row in a plural manner, to each of the cooling headers 22a, 22a, . . . ; and cooling nozzles 22c, 22c, . . . attached to an end portion of the conduits 22b, 22b, . . . The lower surface water supplying devices 22, 22, . . . are arranged opposite to the above described upper surface water supplying devices 21, 21 . . . ; thus, a direction of a jet of cooling water by the lower surface water supplying device differs from that by the upper surface water supplying device. However, the lower surface water supplying device is generally the same in structure as the upper surface water supplying device; so the descriptions of the lower surface water supplying device are omitted here.

As shown in FIG. 3, when correcting a volume of water supplied to the upper surface water supplying devices 21, 21, . . . , a device 21g for adjusting a water supply volume, arranged in a water supplying passageway 21e leading to the cooling headers 21a, 21a, . . . receives a command to correct a water supply volume given from the immediate rapid-cooling control device 52 (see FIG. 1), and thereby adequately corrects the water supply volume. Further, when correcting a water supply pressure, the device 21g for adjusting a water supply volume arranged in a water supplying passageway 21e leading to the cooling headers 21a, 21a, . . . receives a command to correct a water supply pressure given from the immediate rapid-cooling control device 52; corrects the water supply volume such that the pressure value measured by the pressure sensor 21f attached to the cooling headers 21a, 21a, . . . matches the pressure value required in the command; and thereby adequately corrects the water supply pressure.

On the other hand, when correcting a water supply volume and water supply pressure for the lower surface water supplying devices 22, 22, . . . , the same procedures are taken as those for the upper surface water supplying devices 21, 21, . . .

Next, back to FIG. 2, the upper surface guides 25, 25, . . . will be described. The upper surface guides 25, 25, . . . are sheet-like members arranged between the upper surface water supplying device 21 and the steel sheet 1 to be transported, in such a manner that the top portion of the steel sheet 1 does not get caught by the conduits 21b, 21b, . . . and the cooling nozzles 21c, 21c, . . . at a time of passing the top portion of the steel sheet 1. On the other hand, the upper surface guides 25, 25, . . . are provided with inlet holes through which to pass the jet of water from the upper surface water supplying device 21. This enables the jet of water from the upper surface water supplying device 21 to reach the upper surface of the steel sheet 1 through the upper surface guides 25, 25, . . . , and enables adequate cooling. A shape of the upper surface guide 25 to be used herein is not particularly restricted; a known upper surface guide may be used.

The upper surface guides 25, 25, . . . are disposed as shown in FIG. 2. In the present embodiment, three upper surface guides 25, 25, 25 are used and are aligned in the sheet passing direction. All of the upper surface guides 25, 25, 25 are arranged so as to accord with the height of the cooling nozzles 21*c*, 21*c*, . . . That is, in the present embodiment, the upper surface guide 25 closest to the work roll 11*gw* in the final stand 11*g* is arranged in a tilted manner that its end portion on the final stand 11*g* side is positioned lower and its end portion on the other side is positioned higher. The other two upper surface guides 25, 25 are arranged substantially in parallel with the passing sheet surface (i.e. pass line), with a predetermined spacing from the passing sheet surface (the pass line).

The lower surface guide 30 is a sheet-like member arranged between the lower surface water supplying device 22 and the steel sheet 1 to be transported. This prevents the most top portion of the steel sheet from getting caught by the lower surface water supplying devices 22, 22, . . . and the transporting rolls 12, 12, . . . especially when passing the steel sheet 1 into the manufacturing device 10. On the other hand, the lower surface guide 30 is provided with inlet holes through which to pass the jet of water from the lower surface water supplying device 22. This enables the jet of water from the lower surface water supplying device 22 to reach the lower surface of the steel sheet 1 through the lower surface guide 30, and enables adequate cooling. A shape of the lower surface guide to be used herein is not particularly restricted; a conventional lower surface guide may be used.

The lower surface guide 30 as above is disposed as shown in FIG. 2. In the present embodiment, four lower surface guides 30, 30, . . . are used and each of the lower surface guides is disposed between the transporting rolls 12, 12, 12. All of the lower surface guides 30, 30, . . . are arranged at a position which is not too low in relation to the upper end portion of the transporting rolls 12, 12, . . .

In the present embodiment, an example in which the lower surface guide 30 is provided; however, the lower surface guide is not necessarily required.

In supplying cooling water as above, a specific water supply volume is adequately determined based on an amount of heat required to cool a steel sheet; thus is not particularly limited. However, as described above, in view of refining a steel sheet structure, rapid cooling immediately after rolling is effective; and for that purpose, it is preferable to perform cooling with a high water flow density. In view of refining a steel sheet, an example of the water flow density of cooling water to be supplied may be 10 $m^3/(m^2 \cdot min)$ to 25 $m^3/(m^2 \cdot min)$. It should be noted that this water flow density is for one side of a steel sheet and that the water flow density may be higher than this. The cooling capability is preferably 600° C./sec or more in a 3 mm thickness steel sheet.

Back to FIG. 1, the description of the manufacturing device 10 will be continued. The hot-run cooling device 40 is a cooling device for water cooling which is disposed after the pinch roll 13; and is for cooling the steel sheet 1 to a coiling temperature. The hot-run cooling device 40 also comprises an upper surface water supplying device and a lower surface water supplying device as the immediate rapid-cooling device 20 does; and is configured to be capable of cooling both upper and lower surfaces of the steel sheet 1.

The upper surface water supplying device of the hot-run cooling device 40 is a device for supplying cooling water to the upper surface side of the steel sheet 1; and a commonly used cooling device may be adopted here. An example thereof may be a pipe laminar cooling device, which comprises a laminar flow nozzle.

The lower surface water supplying device of the hot-run cooling device 40 is a device for supplying cooling water to the lower surface side of the steel sheet 1; and a commonly used cooling device may be adopted here. An example thereof may be a spray cooling device comprising a "full cone nozzle" which forms a conically-shaped jet of water.

The device 45 for measuring a temperature on an entry side of a final stand measures the surface temperature of the steel sheet 1 on the entry side of the final stand 11*g* in the row 11 of hot finishing mills, as show in FIG. 1. In the manufacturing apparatus 10 of the present embodiment shown in FIG. 1, one device 45 for measuring a temperature on an entry side of a final stand is arranged on the upper surface side or the lower surface side of the steel sheet; however, a plurality of the devices for measuring a temperature on an entry side of a final stand may be arranged. At this time, it is preferable to arrange one on the upper surface side and the other on the lower surface side. By doing so, it is possible to provide an asymmetrical distribution on the upper and the lower surfaces as an initial value of a temperature distribution in the sheet thickness direction, used for predicting a rapid-cooling stopping temperature; and thereby possible to achieve highly precise prediction.

Further, the device 45 for measuring a temperature on an entry side of a final stand may be any kind as long as it is capable of measuring the surface temperature of the steel sheet 1, thus not being restricted to any particular type. In the present embodiment, taking into account the possibility that cooling water is used between the stands in the row 11 of finishing mills, it is preferable to use a so-called water column thermometer in order to reduce measurement errors attributed to the cooling water sprayed herein. As known through Japanese Patent Application Laid-Open No. 2006-010130 and so on, the water column thermometer is a thermometer comprising: a radiation thermometer disposed at a position opposite to the steel sheet 1; and a water column forming means for forming, between the steel sheet 1 and the radiation thermometer, a column of water serving as an optical wave guide. And by detecting radiation light from the surface of the steel sheet 1 via this water column with the radiation thermometer, it is possible to measure the surface temperature of the steel sheet 1 with high precision.

The result of the surface temperature of the steel sheet 1 measured by the device 45 for measuring a temperature on an entry side of a final stand is inputted to the below described cooling control device 50.

The device 46 for measuring a steel sheet thickness measures the thickness of the steel sheet 1 on the entry side 11*g* of the final stand in the row 11 of hot finishing mills, as shown in FIG. 1. The device 46 for measuring a steel sheet thickness may be any kind as long as it is capable of measuring the thickness of the steel sheet 1, thus not being restricted to any particular type. However, taking it into account that the thickness of the steel sheet 1 is less than 30 mm, an X-ray thickness gauge is preferable in order to attain measurement precision and the like in the above mentioned sheet thickness range.

The result of the thickness of the steel sheet 1 measured by the device 46 for measuring a steel sheet thickness is inputted to the below described cooling control device 50.

The device 47 for measuring a steel sheet passing speed is provided to the final stand 11*g* in the row 11 of hot finishing mills, as shown in FIG. 1; and measures the passing speed of the steel sheet 1 on the entry side of the final stand 11*g*. The device 47 for measuring a steel sheet passing speed may be any kind as long as it is capable of measuring the passing speed of the steel sheet 1. In the present embodiment, the passing speed of the steel sheet 1 is obtained by multiplying a circumferential speed of the work rolls 11*gw*, 11*gw* by the forward slip ratio. The result of the passing speed of the steel sheet 1 measured by the device 47 for measuring a steel sheet passing speed is inputted to the below described cooling control device 50.

The device 48 for measuring a temperature on an exit side of an immediate rapid cooling device measures the temperature of the steel sheet on the exit side of the immediate rapid-cooling device 20. The device 49 for measuring a coiling temperature measures the temperature of the steel sheet before the coiling device 14. The device 48 for measuring a temperature on an exit side of an immediate rapid-cooling device and the device 49 for measuring a coiling temperature may be any kinds of sensor as long as they are capable of measuring the surface temperature of the steel sheet 1, thus not being restricted to any particular type.

The cooling control device 50 comprises: the device 51 for predicting a rapid-cooling stopping temperature; and the immediate rapid-cooling control device 52.

The device 51 for predicting a rapid-cooling stopping temperature performs a forecasting calculation of the rapid-cooling stopping temperature, by employing heat transfer model of the steel sheet 1 including rapid cooling by the immediate rapid-cooling device 20, based on: the measured value (FT') of the surface temperature of the steel sheet 1 on the entry side of the final stand 11*g* inputted from the device 45 for measuring a temperature on an entry side of a final stand; the measured value of the thickness of the steel sheet 1 inputted from the device 46 for measuring a steel sheet thickness; and the measured value of the transporting speed of the steel sheet 1 inputted from the device 47 for measuring a steel sheet passing speed. Then the device 51 for predicting a rapid-cooling stopping temperature obtains the predicted rapid-cooling stopping temperature. Detailed examples of the calculation performed herein will be given later.

The immediate rapid-cooling control device 52 judges whether the given target rapid-cooling stopping temperature matches the predicted rapid-cooling stopping temperature calculated by the above device 51 for predicting a rapid-cooling stopping temperature, during the time period from the top portion of the steel sheet 1 reaching the device 45 for measuring a temperature on an entry side of a final stand and to the top portion reaching the device 48 for measuring a temperature on an exit side of an immediate rapid cooling device, in other words, until the top portion of the steel sheet 1 passes through the immediate rapid-cooling device 20. And in a case when the temperatures do not match, the cooling water volume of the immediate rapid-cooling device 20 is controlled.

Further, after the top portion reaches the device 48 for measuring a temperature on an exit side of an immediate rapid cooling device, in other words, after the top portion of the steel sheet 1 passes through the immediate rapid-cooling device 20, at least one of the cooling water volume of the immediate rapid-cooling device 20 and the passing speed of the steel sheet is controlled such that the given target rapid-cooling stopping temperature matches the temperature measured in the device 48 for measuring a temperature on an exit side of an immediate rapid cooling device.

With the manufacturing apparatus 10 having the above described configuration, the temperature of the steel sheet is controlled to a desired rapid-cooling stopping temperature, thereby enabling manufacturing of a hot-rolled steel sheet having an expected structure.

Next, an example of a method for manufacturing a hot-rolled steel sheet by using the manufacturing apparatus 10 will be described. This method is for matching the predicted rapid-cooling stopping temperature with the target rapid-cooling stopping temperature by varying the water supply volume of the immediate rapid-cooling device 20.

The surface temperature, sheet thickness, and passing speed of the steel sheet 1 having reached the entry side of the final stand 11*g* in the row 11 of hot finishing mills are measured respectively by the device 45 for measuring a temperature on an entry side of a final stand, the device 46 for measuring a steel sheet thickness, and the device 47 for measuring a steel sheet passing speed. By Formula (1), the device 51 for predicting a rapid-cooling stopping temperature calculates the temperature on the entry side of the final stand 11*g* from the temperature, sheet thickness, passing speed, specific heat, density, etc. of the steel sheet. Formula 1 represents a temperature reduction $\Delta T_1$ from the device 45 for measuring a temperature on an entry side of a final stand to the final stand 11*g*, the temperature reduction being carried out by air cooling.

[Formula 1]

$$\Delta T_1 = \frac{2\sigma\varepsilon}{c\rho h_1}\left\{\left(\frac{T_{S1}+273}{100}\right)^4 - \left(\frac{T_A+273}{100}\right)^4\right\}t_1 + \frac{2\alpha_A}{c\rho h_1}(T_{S1}-T_A)t_1 \quad (1)$$

Herein, $\sigma$ represents Stefan-Boltzmann's constant ($W/m^2 \cdot K^4$). $\epsilon$ represents an emissivity of the steel sheet 1. c represents a specific heat (J/kg·K) of the steel sheet 1. $\rho$ represents a density ($kg/m^3$) of the steel sheet 1. $h_1$ represents a sheet thickness (m) before the final stand 11*g*. $\alpha_A$ represents a heat transfer coefficient ($W/m^2 \cdot K$) in air cooling. Further, $T_{S1}$ represents a surface temperature (° C.) of the steel sheet 1 in the above mentioned zone. $T_A$ represents an air temperature (° C.). $t_1$ represents the time (sec.) in which the steel sheet passes through this zone.

Subsequently, by Formulas 2 and 3 the temperature on the exit side of the rolling stand is calculated from the temperature of the work roll 11*gw* of the final stand 11*g*; the contact time of the steel sheet with the work roll 11*gw*; the roll torque, etc. Formula 2 represents a temperature reduction $\Delta T_2$ by the contact of the steel sheet 1 in the final stand 11*g* with the work roll 11*gw*.

[Formula 2]

$$\Delta T_2 = \frac{2}{c\rho h_2}\sqrt{\frac{\lambda c\rho t_R}{\pi}}\,(T_{S2}-T_R) \quad (2)$$

Herein, c represents a specific heat (J/kg·K) of the steel sheet 1. $\rho$ represents a density ($kg/m^3$) of the steel sheet 1. $\lambda$ represents a thermal conductivity (W/m·K) of the steel sheet 1. Further, $h_2$ represents a sheet thickness (m) after the final stand 11*g*. $t_R$ represents the time (sec.) during which the steel sheet 1 is in contact with the work roll 11*gw* of the final stand 11*g*. $T_{S2}$ represents a surface temperature (° C.) of the steel sheet 1 during contact with the work roll 11*gw*. $T_R$ represents a temperature of the work roll 11*gw*.

On the other hand, Formula 3 represents a temperature increase $\Delta T_3$ by rolling in the final stand 11*g*.

[Formula 3]

$$\Delta T_3 = \frac{2}{c\rho h_2}\frac{\eta G}{wr} \tag{3}$$

Herein, c represents a specific heat (J/kg·K) of the steel sheet 1. ρ represents a density (kg/m$^3$) of the steel sheet 1. η represents a heat processing efficiency. G represents a rolling torque (N·m). Additionally, r represents a diameter (m) of the work roll 11*gw*. w represents a sheet width (m) of the steel sheet. $h_2$ represents a sheet thickness (m) after the final stand 11*g*.

Next, the temperature of the steel sheet until it passes through the immediate rapid-cooling device 20 is predicted from the temperature on the exit side of the final stand 11*g*. At this time, it is necessary to set the cooling water volume in the immediate rapid-cooling device 20. In specific, the temperature is predicted in the following manner. That is, supposing that the water volume supplied from all the headers 21*a*, 21*a*, . . . , 22*a*, 22*a*, . . . of the immediate rapid-cooling device 20 is a minimum water volume including zero (i.e. air cooling), the predicted temperature of the steel sheet passing from the exit of the final stand through the immediate rapid-cooling device 20 is calculated by using Formulas 4 and 5. Formula 4 represents a temperature reduction $\Delta T_{4L}$ by water cooling. Formula 5 represents a temperature reduction $\Delta T_{4A}$ by air cooling.

[Formula 4]

$$\Delta T_{4L} = \frac{2\alpha_R}{c\rho h_2}(T_{S4L} - T_L)t_{4L} \tag{4}$$

[Formula 5]

$$\Delta T_{4A} = \frac{2\sigma\varepsilon}{c\rho h_2}\left\{\left(\frac{T_{S2A}+273}{100}\right)^4 - \left(\frac{T_A+273}{100}\right)^4\right\}t_{4A} + \frac{2\alpha_A}{c\rho h_2}(T_{S4A} - T_A)t_{4A} \tag{5}$$

Herein, ° represents Stefan-Boltzmann's constant (W/m$^2$·K$^4$). ϵ represents an emissivity (–) of the steel sheet 1. c represents a specific heat (J/kg·K) of the steel sheet 1. ρ represents a density (kg/m$^3$) of the steel sheet 1. $\alpha_A$ represents a heat transfer coefficient (W/m$^2$·K) in an air-cooling area. $\alpha_R$ represents a heat transfer coefficient (W/m$^2$·K) by water cooling of the immediate rapid-cooling device 20. $h_2$ represents a sheet thickness (m) after the final stand 11*g*. $T_{S4L}$ represents a surface temperature (° C.) of the steel sheet 1 in the water-cooling area of the immediate rapid-cooling device 20. $T_{S4A}$ represents a surface temperature (° C.) of the steel sheet 1 in the air-cooling area of the immediate rapid-cooling device 20. $T_A$ represents an air temperature (° C.). $T_L$ represents a temperature of cooling water. $t_{4L}$ represents the time (sec.) in which the steel sheet passes through the water-cooling area in the immediate rapid-cooling device 20. $t_{4A}$ represents the time (sec.) in which the steel sheet passes through the air-cooling area in the immediate rapid-cooling device 20.

The cooling water volume is determined by using a convergence calculation method such as a bisection method, the cooling water volume enabling thus obtained predicted value of the temperature after passing through the immediate rapid-cooling device 20 to match a target rapid-cooling stopping temperature. And this cooling water volume calculated by the device 51 for predicting a rapid-cooling stopping temperature is sent to the immediate rapid-cooling control device 52; and the immediate rapid-cooling device 20 is given a command to run off the determined water volume.

Other than by adjusting the cooling water volume, as a way of matching the temperature of the steel sheet 1 after passing through the immediate rapid-cooling device 20 with the target rapid-cooling stopping temperature, it is possible to achieve similar effects also by adjusting the water supply pressure of the immediate rapid-cooling device 20.

By the above method, the cooling water volume or water supply pressure of the immediate rapid-cooling device 20 is appropriately adjusted such that the rapid-cooling stopping temperature predicted by the device 51 for predicting a rapid-cooling stopping temperature matches the target rapid-cooling stopping temperature; thereby the rapid-cooling stopping temperature can be controlled with high precision.

Further, after the top portion of the steel sheet 1 reaches the device 48 for measuring a temperature on an exit side of an immediate rapid-cooling device, the immediate rapid-cooling control device 52 performs a feedback control of the cooling water volume or water supply pressure of the immediate rapid-cooling device 20, such that the target rapid-cooling stopping temperature matches the temperature measured in the device 48 for measuring a temperature on an exit side of an immediate rapid-cooling device; thereby even when prediction errors arise in the rapid-cooling stopping temperature predicted by the device 51 for predicting a rapid-cooling stopping temperature, the errors can be corrected and the rapid-cooling stopping temperature can be controlled with high precision over the entire length of the steel sheet 1.

In the above example, the cooling water volume or water supply pressure of the immediate rapid-cooling device 20 is adjusted, thereby matching the predicted rapid-cooling stopping temperature with the target temperature. However, the rapid-cooling stopping temperature can be controlled also by keeping the cooling water volume or water supply pressure constant and adjusting a rolling speed. In general, a responsive property of a rolling motor which adjusts a rolling speed is better in response than a responsive property (adjustment of water volume) of a valve which adjusts a cooling capability of a cooling device; thus, control of the rapid-cooling stopping temperature is better performed by adjusting the rolling speed. It should be noted, however, that in order to adjust the rolling speed, there increase difficulties in the rolling technique, such as having to adjust the rolling speed in the whole row 11 of hot finishing mills all at once.

In the method of adjusting the cooling water volume, there has been illustrated a way of performing a feedback control of the cooling water volume of the immediate rapid-cooling device 20 after the top portion of the steel sheet reaches the device 48 for measuring a temperature on an exit side of an immediate rapid-cooling device. However, in the method of adjusting the rolling speed, it is possible to perform a feedback control of the rolling speed such that the temperature measured in the device 48 for measuring a temperature on an exit side of an immediate rapid-cooling device matches the target rapid-cooling stopping temperature. In specific, if the measured temperature is higher than the target temperature, the rolling speed may be adjusted to a low speed; and if the measured temperature is lower than the target temperature, the rolling speed may be adjusted to a high speed.

Figure 5:
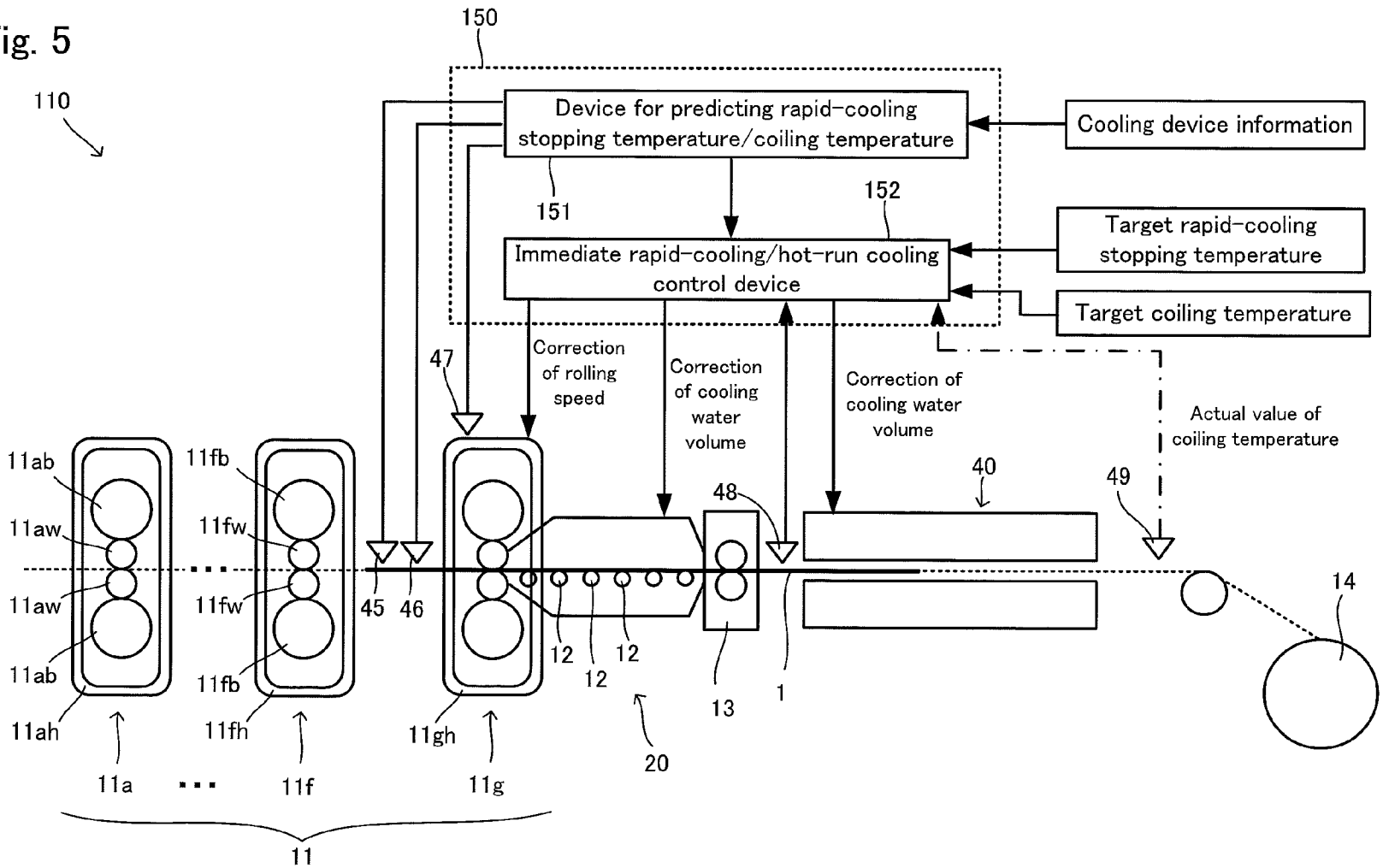
FIG. 5 is a schematic view showing a part of a manufacturing apparatus of a hot-rolled steel sheet according to a second embodiment.

FIG. 5 is a conceptual view illustrating a manufacturing apparatus 110 of a hot-rolled steel sheet (hereinafter, sometimes referred to as a "manufacturing apparatus 110"), in accordance with a second embodiment. FIG. 5 corresponds to FIG. 1. The manufacturing apparatus 110 differs from the manufacturing apparatus 10 in terms of a cooling control device 150. The other components are common in these manufacturing apparatuses; thus the same symbols are given to those common components, and the descriptions thereof are omitted.

The cooling control device 150 comprises: the device 151 for predicting a rapid-cooling stopping temperature/coiling temperature; and the immediate rapid-cooling/hot-run cooling control device 152.

The device 151 for predicting a rapid-cooling stopping temperature/coiling temperature performs a forecasting calculation of the rapid-cooling stopping temperature and coiling temperature to be realized by the immediate rapid-cooling device 20 and the hot-run cooling device 40, by employing a heat transfer model of the steel sheet 1, based on: the measured value (FT') of the surface temperature of the steel sheet 1 on the entry side of the final stand 11*g* inputted from the device 45 for measuring a temperature on an entry side of a final stand; the measured value of the sheet thickness of the steel sheet 1 inputted from the device 46 for measuring a steel sheet thickness; and the measured value of the transporting speed of the steel sheet 1 inputted from the device 47 for measuring a steel sheet passing speed. Thereby, a predicted value is obtained for each of the rapid-cooling stopping temperature and coiling temperature. Detailed examples of the calculation performed herein will be given later.

The immediate rapid-cooling/hot-run cooling control device 152 judges whether the given target rapid-cooling stopping temperature matches the predicted rapid-cooling stopping temperature calculated by the above device 151 for predicting a rapid-cooling stopping temperature/coiling temperature, during the time period from the top portion of the steel sheet 1 reaching the device 45 for measuring a temperature on an entry side of a final stand and to the top portion reaching the device 48 for measuring a temperature on an exit side of an immediate rapid cooling device. And in a case when the temperatures do not match, the cooling water volume of the immediate cooling control device 20 is controlled. Additionally, after the top portion of the steel sheet 1 reaches the device 48 for measuring a temperature on an exit side of an immediate rapid cooling device, the cooling water volume of the immediate rapid-cooling device and/or the passing speed of the steel sheet 1 are controlled such that the given target rapid-cooling stopping temperature matches the temperature measured in the device 48 for measuring a temperature on an exit side of an immediate rapid cooling device.

Furthermore, the immediate rapid-cooling/hot-run cooling control device 152 judges whether the given target coiling temperature matches the predicted coiling temperature calculated by the above device 151 for predicting a rapid-cooling stopping temperature/coiling temperature, until the top portion of the steel sheet 1 reaches the device 49 for measuring a coiling temperature. And in a case when the temperatures do not match, the cooling water volume of the hot-run cooling device 40 is controlled. Additionally, after the top portion reaches the device 49 for measuring a coiling temperature, at least one of the cooling water volume of the hot-run cooling device 40 and the passing speed of the steel sheet 1 is controlled such that the given target coiling temperature matches the temperature measured by the device 49 for measuring a coiling temperature.

With the manufacturing apparatus 110 having the above configuration, the temperature of the steel sheet is controlled to a desired rapid-cooling stopping temperature and a desired coiling temperature, thereby enabling manufacturing of a hot-rolled steel sheet having an expected structure.

Next, an example of a method for manufacturing a hot-rolled steel sheet by using the manufacturing apparatus 110 will be described. This example is about matching the predicted rapid-cooling stopping temperature and predicted coiling temperature respectively with the target rapid-cooling stopping temperature and target coiling temperature, by varying the water supply volume of the immediate rapid-cooling device 20 and the hot-run cooling device 40.

The surface temperature, sheet thickness, and passing speed of the steel sheet 1 having reached the entry side of the final stand 11*g* are measured respectively by the device 45 for measuring a temperature on an entry side of a final stand, the device 46 for measuring a steel sheet thickness, and the device 47 for measuring a steel sheet passing speed. By Formula (1), the device 151 for predicting a rapid-cooling stopping temperature/coiling temperature calculates the temperature on the entry side of the final stand 11*g*, based on the above temperature, sheet thickness, passing speed, and the like.

Subsequently, by Formulas 2 and 3, the temperature on the exit side of the rolling stand is calculated from the temperature of the work roll 11*gw* of the final stand 11*g*, the contact time of the steel sheet with the roll, the roll torque, etc.

Next, the temperature of the steel sheet until it passes through the immediate rapid-cooling device 20 is predicted from the temperature on the exit side of the final stand 11*g*. At this time, it is necessary to set the cooling water volume in the immediate rapid-cooling device 20. In specific, the temperature is predicted in the following manner. That is, supposing that the water volume supplied from all the headers 21*a*, 21*a*, . . . , 22*a*, 22*a*, . . . of the immediate rapid-cooling device 20 is a minimum water volume including zero (i.e. air cooling), the predicted temperature of the steel sheet 1 passing from the exit of the final stand through the immediate rapid-cooling device 20 is calculated by using Formulas 4 and 5.

The cooling water volume is determined by using a convergence calculation method such as a bisection method, the cooling water volume enabling thus obtained predicted value of the temperature after passing through the immediate rapid-cooling device 20 to match the target rapid-cooling stopping temperature. And this cooling water volume calculated by the device 151 for predicting a rapid-cooling stopping temperature/coiling temperature is sent to the immediate rapid-cooling/hot-run cooling control device 152; and the immediate rapid-cooling device 20 is given a command to run off the determined water volume.

Other than by adjusting the cooling water volume, as a way of matching the temperature of the steel sheet 1 after passing through the immediate rapid-cooling device 20 with the target rapid-cooling stopping temperature, it is possible to achieve similar effects also by adjusting the water supply pressure of the immediate rapid-cooling device 20.

In the present embodiment, further subsequently, the temperature of the steel sheet until it passes through the hot-run cooling device 40 is predicted from the temperature measured in the device 48 for measuring a temperature on an exit side of an immediate rapid-cooling device. At this time, it is necessary to set the cooling water volume of the hot-run cooling device 40. First, supposing that the water supply volume from all the cooling headers in the hot-run cooling device 40 is a minimum water volume including zero amount of water (i.e. air cooling), the predicted temperature of the steel sheet passing from the device 48 for measuring a temperature on an exit side of an immediate rapid-cooling device through the hot-run cooling device 40 is calculated by using Formulas 6 and 7. Formula 6 represents a temperature reduction $\Delta T_{5L}$ by water cooling. Formula 7 represents a temperature reduction $\Delta_{5A}$ by air cooling.

[Formula 6]

$$\Delta T_{5L} = \frac{2\alpha_L}{c\rho h_2}(T_{S5L} - T_L)t_{5L} \tag{6}$$

[Formula 7]

$$\Delta T_{5A} = \frac{2\sigma\varepsilon}{c\rho h_2}\left\{\left(\frac{T_{S5A}+273}{100}\right)^4 - \left(\frac{T_A+273}{100}\right)^4\right\}t_{5A} + \frac{2\alpha_A}{c\rho h_2}(T_{S5A} - T_A)t_{5A} \tag{7}$$

Herein, σ represents Stefan-Boltzmann's constant ($W/m^2 \cdot K^4$). ϵ represents an emissivity (–) of the steel sheet 1. c represents a specific heat (J/kg·K) of the steel sheet 1. P represents a density ($kg/m^3$) of the steel sheet 1. $\alpha_A$ represents a heat transfer coefficient ($W/m^2 \cdot K$) in an air-cooling area. $\alpha_L$ represents a heat transfer coefficient ($W/m^2 \cdot K$) by water cooling of the hot-run cooling device 40. $h_2$ represents a sheet thickness (m) after the final stand 11*g*. $T_{S5L}$ represents a surface temperature (° C.) of the steel sheet 1 in the water-cooling area of the hot-run cooling device 40. $T_{S5A}$ represents a surface temperature (° C.) of the steel sheet 1 in the air-cooling area of the hot-run cooling device 40. $T_A$ represents an air temperature (° C.). $T_L$ represents a temperature of cooling water. $t_{5L}$ represents the time (sec.) in which the steel sheet passes through the water-cooling area of the hot-run cooling device 40. $t_{5A}$ represents the time (sec.) in which the steel sheet passes through the air-cooling area of the hot-run cooling device 40.

And the value of the temperature prediction at a time of passing through the hot-run cooling device 40 is calculated; and in such a way that this value matches the target coiling temperature, the cooling water volume of the hot-run cooling device 40 is determined by using a convergence calculation method such as a bisection method. And this cooling water volume of the hot-run cooling device 40 calculated by the device 151 for predicting a rapid-cooling stopping temperature/coiling temperature is send to the immediate rapid-cooling/hot-run cooling control device 152; and the hot-run cooling device 40 is given an operation command to run off the set water volume.

By the above method, the cooling water volume of the immediate rapid-cooling device 20 and the cooling water volume of the hot-run cooling device 40 are appropriately adjusted, enabling highly precise control of the rapid-cooling stopping temperature and coiling temperature.

After the top portion of the steel sheet 1 reaches the device 48 for measuring a temperature on an exit side of an immediate rapid-cooling device, the immediate rapid-cooling/hot-run cooling control device 152 performs a feedback control of the cooling water volume of the immediate rapid-cooling device 20, such that the target rapid-cooling stopping temperature matches the temperature measured in the device 48 for measuring a temperature on an exit side of an immediate rapid-cooling device. Further, after the top portion of the steel sheet 1 reaches the device 49 for measuring a coiling temperature, the immediate rapid-cooling/hot-run cooling control device 152 performs a feedback control of the cooling water volume of the hot-run cooling device 40, such that the target coiling temperature matches the temperature measured in the device 49 for measuring a coiling temperature. By this, even when prediction errors arise in the rapid-cooling stopping temperature and coiling temperature predicted by the device 151 for predicting a rapid-cooling stopping temperature/coiling temperature, the rapid-cooling stopping temperature and coiling temperature can be controlled with high precision over the entire length of the steel sheet 1.

As described in the first embodiment, in the present embodiment as well, by keeping the cooling water volume of the immediate rapid-cooling device 20 constant and adjusting the rolling speed, it is possible to control the rapid-cooling stopping temperature such that the temperature measured in the device 48 for measuring a temperature on an exit side of an immediate rapid-cooling device matches the target rapid-cooling stopping temperature.

At this time, however, if the feedback control of the rolling speed is performed so as to match the temperature measured in the device 48 for measuring a temperature on an exit side of an immediate rapid-cooling device with the target temperature, the coiling temperature changes according to the change in the rolling speed. Therefore, the immediate cooling/hot-run cooling control device 152 performs a feedback control of the cooling water volume of the hot-run cooling device 40 such that the temperature measured in the device 49 for measuring a coiling temperature matches the target coiling temperature.

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a manufacturing apparatus of a hot-rolled steel sheet and a manufacturing method of a hot-rolled steel sheet with such modifications are also encompassed within the technical range of the invention.

| Description of the Symbols | |
|---|---|
| 1 | steel sheet |
| 10 | manufacturing apparatus of hot-rolled steel sheet |
| 11 | row of hot finishing mills |
| 11g | final stand |
| 11gh | housing |
| 11gr | standing side member (of housing)(:side wall) |
| 11gw | work roll |
| 12 | transporting roll |
| 13 | pinch roll |
| 14 | coiling device |
| 20 | immediate rapid-cooling device |
| 21 | upper surface water supplying device |
| 21a | cooling header |
| 21b | conduit |
| 21c | cooling nozzle |
| 22 | lower surface water supplying device |
| 22a | cooling header |
| 22b | conduit |
| 22c | cooling nozzle |
| 25 | upper surface guide |
| 30 | lower surface guide |
| 40 | hot-run cooling device |
| 45 | device for measuring temperature on entry side of final stand |
| 46 | device for measuring steel sheet thickness |
| 47 | device for measuring steel sheet passing speed |
| 48 | device for measuring temperature on exit side of immediate rapid-cooling device |
| 49 | device for measuring coiling temperature |
| 50 | cooling control device |
| 51 | device for predicting rapid-cooling stopping temperature |
| 52 | immediate rapid-cooling control device |
| 110 | manufacturing apparatus of hot-rolled steel sheet (device for measuring steel sheet passing speed) |

-continued

| Description of the Symbols | |
|---|---|
| 150 | cooling control device |
| 151 | device for predicting rapid-cooling stopping temperature/coiling temperature |
| 152 | immediate rapid-cooling/hot-run cooling control device |

The invention claimed is:

1. A manufacturing apparatus of a hot-rolled steel sheet comprising:

a row of hot finishing mills;

an immediate rapid-cooling device, which is disposed on an exit side of a final stand in the row of hot finishing mills, and at least a part of which is disposed inside the final stand so as to be capable of spraying cooling water;

a device for measuring a temperature on an entry side of a final stand, which is arranged in a manner capable of measuring a surface temperature of a steel sheet on an entry side of the final stand;

a device for measuring a steel sheet passing speed, which is arranged in a manner capable of measuring a passing speed of the steel sheet on the entry side of the final stand;

a device for predicting a rapid-cooling stopping temperature, which calculates a predicted rapid-cooling stopping temperature based on: the surface temperature of the steel sheet measured by the device for measuring a temperature on an entry side of a final stand; the steel sheet passing speed measured by the device for measuring the steel sheet passing speed; and the water supply volume or water supply pressure of the immediate rapid-cooling device; and an immediate rapid-cooling control device, which corrects the water supply volume or water supply pressure of the immediate rapid-cooling device such that the predicted rapid-cooling stopping temperature matches a targeted rapid-cooling stopping temperature.

2. A manufacturing method of a hot-rolled steel sheet using the manufacturing apparatus of a hot-rolled steel sheet according to claim 1, wherein with a measured value of the steel sheet temperature on the entry side of the final stand as an initial value, the predicted rapid-cooling stopping temperature is calculated based on the surface temperature of the steel sheet and the water supply volume or water supply pressure of the immediate rapid-cooling device; and the water supply volume or water supply pressure of the immediate rapid-cooling device is corrected such that the predicted rapid-cooling stopping temperature matches a targeted rapid-cooling stopping temperature.

3. A manufacturing apparatus of a hot-rolled steel sheet comprising:

a row of hot finishing mills;

an immediate rapid-cooling device, which is disposed on an exit side of a final stand in the row of hot finishing mills, and at least a part of which is disposed inside the final stand so as to be capable of spraying cooling water;

a device for measuring a temperature on an entry side of a final stand, which is arranged in a manner capable of measuring a surface temperature of a steel sheet on an entry side of the final stand;

a device for measuring a temperature on an exit side of an immediate rapid-cooling device, which is arranged in a manner capable of measuring the surface temperature of the steel sheet on an exit side of the immediate rapid-cooling device;

a device for measuring a steel sheet passing speed, which is arranged in a manner capable of measuring a passing speed of the steel sheet on the entry side of the final stand;

a device for predicting a rapid-cooling stopping temperature, which calculates a predicted rapid-cooling stopping temperature based on the surface temperature of the steel sheet measured by the device for measuring a temperature on an entry side of a final stand, the steel sheet passing speed measured by the device for measuring a steel sheet passing speed, and the water supply volume or water supply pressure of the immediate rapid-cooling device; and an immediate rapid-cooling control device, which corrects the water supply volume or water supply pressure of the immediate rapid-cooling device such that the predicted rapid-cooling stopping temperature matches a targeted rapid-cooling stopping temperature, until a top portion of the steel sheet passes through the immediate rapid-cooling device, and which corrects the water supply volume or water supply pressure of the immediate rapid-cooling device, or the steel sheet passing speed such that the temperature measured by the device for measuring a temperature on an exit side of an immediate rapid-cooling device matches the targeted rapid-cooling stopping temperature, after the top portion of the steel sheet passes through the immediate rapid-cooling device.

4. A manufacturing method of a hot-rolled steel sheet using the manufacturing apparatus of a hot-rolled steel sheet according to claim 3, wherein until the top portion of the steel sheet passes through the immediate rapid-cooling device, with a measured value of the steel sheet temperature on the entry side of the final stand as an initial value, the predicted rapid-cooling stopping temperature is calculated based on the surface temperature of the steel sheet and the water supply volume or water supply pressure of the immediate rapid-cooling device, and the water supply volume or water supply pressure of the immediate rapid-cooling device is corrected such that the predicted rapid-cooling stopping temperature matches a targeted rapid-cooling stopping temperature; and after the top portion of the steel sheet passes through the immediate rapid-cooling device, the water supply volume or water supply pressure of the immediate rapid-cooling device, or the steel sheet passing speed is corrected such that the measured value by the device for measuring a temperature on an exit side of an immediate rapid-cooling device matches the targeted rapid-cooling stopping temperature.

5. A manufacturing apparatus of a hot-rolled steel sheet comprising:

a row of hot finishing mills;

an immediate rapid-cooling device, which is disposed on an exit side of a final stand in the row of hot finishing mills, and at least a part of which is disposed inside the final stand so as to be capable of spraying cooling water;

a hot-run cooling device, which is disposed on an outer side of the immediate rapid-cooling device;

a device for measuring a temperature on an entry side of a final stand, which is arranged in a manner capable of measuring a surface temperature of a steel sheet on an entry side of the final stand;

a device for measuring a steel sheet passing speed, which is arranged in a manner capable of measuring a passing speed of the steel sheet on the entry side of the final stand;

a device for predicting a rapid-cooling stopping temperature/coiling temperature, which calculates a predicted rapid-cooling stopping temperature and predicted coiling temperature based on: the surface temperature of the steel sheet measured by the device for measuring a temperature on an entry side of a final stand; the steel sheet passing speed measured by the device for measuring a steel sheet passing speed; the water supply volume or water supply pressure of the immediate rapid-cooling device; and the water supply volume of the hot-run cooling device; and an immediate rapid-cooling/hot-run cooling control device, which corrects the water supply volume or water supply pressure of the immediate rapid-cooling device such that the predicted rapid-cooling stopping temperature and predicted coiling temperature match a targeted rapid-cooling stopping temperature and targeted coiling temperature.

6. A manufacturing method of a hot-rolled steel sheet using the manufacturing apparatus of a hot-rolled steel sheet according to claim 5, wherein with a measured value of the steel sheet temperature on the entry side of the final stand as an initial value, the predicted rapid-cooling stopping temperature and predicted coiling temperature are calculated based on the surface temperature of the steel sheet, the water supply volume or water supply pressure of the immediate rapid-cooling device, and the water supply volume of the hot-run cooling device; and the water supply volume or water supply pressure of the immediate rapid-cooling device is corrected and the water supply volume of the hot-run cooling device is corrected, such that the predicted rapid-cooling stopping temperature and predicted coiling temperature match a targeted rapid-cooling stopping temperature and targeted coiling temperature.

7. A manufacturing apparatus of a hot-rolled steel sheet comprising:

a row of hot finishing mills;

an immediate rapid-cooling device, which is disposed on an exit side of a final stand in the row of hot finishing mills, and at least a part of which is disposed inside the final stand so as to be capable of spraying cooling water;

a hot-run cooling device, which is disposed on an outer side of the immediate rapid-cooling device;

a device for measuring a temperature on an entry side of a final stand, which is arranged in a manner capable of measuring a surface temperature of a steel sheet on an entry side of the final stand;

a device for measuring a temperature on an exit side of an immediate rapid-cooling device, which is arranged in a manner capable of measuring the surface temperature of the steel sheet on an exit side of the immediate rapid-cooling device;

a device for measuring a steel sheet passing speed, which is arranged in a manner capable of measuring a passing speed of the steel sheet on the entry side of the final stand;

a device for predicting a rapid-cooling stopping temperature/coiling temperature, which calculates a predicted rapid-cooling stopping temperature and predicted coiling temperature based on: the surface temperature of the steel sheet measured by the device for measuring a temperature on an entry side of a final stand; the steel sheet passing speed measured by the device for measuring a steel sheet passing speed; the water supply volume or water supply pressure of the immediate rapid-cooling device; and the water supply volume of the hot-run cooling device; and an immediate rapid-cooling/hot-run cooling control device, which corrects the water supply volume or water supply pressure of the immediate rapid-cooling device and the water supply volume of the hot-run cooling device such that the predicted rapid-cooling stopping temperature and predicted coiling temperature match a targeted rapid-cooling stopping temperature and targeted coiling temperature, until a top portion of the steel sheet passes through the immediate rapid-cooling device, and which corrects the water supply volume or water supply pressure of the immediate rapid-cooling device, or the steel sheet passing speed such that the temperature measured by the device for measuring a temperature on an exit side of an immediate rapid-cooling device matches the targeted rapid-cooling stopping temperature, and corrects the water supply volume of the hot-run cooling device such that the predicted coiling temperature matches the targeted coiling temperature, after the top portion of the steel sheet passes through the immediate rapid-cooling device.

8. A manufacturing method of a hot-rolled-steel sheet using the manufacturing apparatus of a hot-rolled steel sheet according to claim 7, wherein until the top portion of the steel sheet passes through the immediate rapid-cooling device, with a measured value of the steel sheet temperature on the entry side of the final stand as an initial value, the predicted rapid-cooling stopping temperature and predicted coiling temperature are calculated based on the surface temperature of the steel sheet, the water supply volume or water supply pressure of the immediate rapid-cooling device, and the water supply volume of the hot-run cooling device; and the water supply volume or water supply pressure of the immediate rapid-cooling device is corrected and the water supply volume of the hot-run cooling device is corrected, such that the predicted rapid-cooling stopping temperature and predicted coiling temperature match a targeted rapid-cooling stopping temperature and targeted coiling temperature; and after the top portion of the steel sheet passes through the immediate rapid-cooling, the water supply volume or water supply pressure of the immediate rapid-cooling device, or the steel sheet passing speed is corrected such that the temperature measured by the device for measuring a temperature on an exit side of an immediate rapid-cooling device matches the targeted rapid-cooling stopping temperature, and the water supply volume of the hot-run cooling device is corrected such that the predicted coiling temperature matches the targeted coiling temperature.

* * * * *